US008754722B2

(12) United States Patent
Choi et al.

(10) Patent No.: US 8,754,722 B2
(45) Date of Patent: Jun. 17, 2014

(54) PLANAR INTEGRATED SWITCHING DEVICE

(75) Inventors: Joo-Young Choi, Fellbach (DE); Stefan Koch, Oppenweiler (DE)

(73) Assignee: Sony Corporation, Tokyo (JP)

( * ) Notice: Subject to any disclaimer, the term of this patent is extended or adjusted under 35 U.S.C. 154(b) by 441 days.

(21) Appl. No.: 13/087,792

(22) Filed: Apr. 15, 2011

(65) Prior Publication Data

US 2011/0279191 A1 Nov. 17, 2011

(30) Foreign Application Priority Data

May 12, 2010 (EP) ..... 10162701

(51) Int. Cl.
*H01P 1/10* (2006.01)
*H01P 3/08* (2006.01)

(52) U.S. Cl.
USPC ..... 333/104; 333/238

(58) Field of Classification Search
USPC ..... 333/101, 103, 104, 105, 238
See application file for complete search history.

(56) References Cited

U.S. PATENT DOCUMENTS 5,265,266 A * 11/1993 Trinh ..... 455/326
7,414,500 B2 * 8/2008 De Los Santos ..... 335/78
7,605,674 B2 * 10/2009 Kim ..... 333/103

FOREIGN PATENT DOCUMENTS

WO WO 97/17738 A1 5/1997

OTHER PUBLICATIONS

Chien-Hsun Ho, et al., "Transmission Line Modeling of CPW-Slotline Transitions and CPW Butterfly Filters", IEEE MTT-S Digest, 1994, pp. 1305-1308.
Yong-Hui Shu, et al., "Electronically Switchable and Tunable Coplanar Waveguide-Slotline Band-Pass Filters", IEEE Transactions on Microwave Theory and Techniques, vol. 39, No. 3, Mar. 1991, pp. 548-554.

* cited by examiner

*Primary Examiner* — Dean O Takaoka
(74) *Attorney, Agent, or Firm* — Oblon, Spivak, McClelland, Maier & Neustadt, L.L.P.

(57) ABSTRACT

The present invention provides a space saving and simply implementable planar integrated switching device comprising at least two CPW-slotline transition units each including an access for inputting and/or outputting a transmission signal, a slotline connecting said at least two CPW-slotline transition units, and a switching element arranged on said slotline between said at least two CPW-slotline transition units for switching the transmission signal over said slotline on and off under control of a switch control signal.

19 Claims, 7 Drawing Sheets

RELATED ART

RELATED ART

PLANAR INTEGRATED SWITCHING DEVICE

CROSS-REFERENCE TO RELATED APPLICATIONS

The present application claims priority of European patent application 10162701.6 filed on May 12, 2010.

FIELD OF THE INVENTION

The present invention relates to a planar integrated switching device as well as to a device for the transmission of microwave signals. The present invention relates particularly to planar millimeter wave or microwave integrated circuits.

BACKGROUND OF THE INVENTION

Coplanar waveguide (CPW) and slotline are the most widely used uniplanar transmission lines. The use of uniplanar transmission lines allows easy series and shunt devices without via holes and easy mounting of external components, and thus, offers great design flexibility. These characteristics make CPW and slotline important in MIC (Microwave Integrated Circuit) and MMIC (Millimeter Wave Integrated Circuit) design. To fully utilize the advantages of uniplanar structures, broadband transitions of CPW-slotline are necessary. Such CPW-slotline transitions are, for instance, described in WO 97/17738 A1 and the article of C. Ho, L. Fan and K. Chang, "Transmission Line Modeling of CPW-Slotline Transitions and CPW Butterfly Filters", in IEEE MTT-S Digest, 1994, pp. 1305-1308.

Switches are one of the indispensable devices in microwave and millimeter wave systems, and generally are connected with other components in series. This, however, requires more space for the switches in the system, and also mostly requires additional impedance matching networks which can make system design more complicated.

U.S. Pat. No. 7,605,674 B2 discloses a radiofrequency switch for switching between a transmission signal and a received signal at a signal transmission/reception end in a time division duplexing system. In said RF switch a slotline is divided into a first slotline and a second slotline, and an open-end circuit is provided at each end portion of the first and second slotlines. A first transmission line delivers signals from and to the first slotline, and a second transmission line delivers signals from and to the second slotline. A third transmission line delivers signals from and to the portion of the slotline that separates the first slotline from the second slotline. A variable subopen-end circuit portion includes at least one open-end circuit, which is selectively switched to the first or second slotline according to an external switching control signal.

BRIEF SUMMARY OF THE INVENTION

It is an object of the present invention to provide a planar integrated switching device requiring less space and enabling a simpler and though better electrical performance design. It is a further object of the present invention to provide a corresponding device for the transmission of microwave signals.

According to an aspect of the present invention there is provided a planar integrated switching device comprising:

- at least two CPW-slotline transition units each including an access configured to input and/or output a transmission signal,

- a slotline connecting said at least two CPW-slotline transition units, and
- a switching element arranged on said slotline between said at least two CPW-slotline transition units and configured to switch the transmission of a transmission signal over said slotline on and off under control of a switch control signal.

According to a further aspect of the present invention there is provided a device for the transmission of microwave signals comprising:

- one or more signal input terminals,
- one or more signal output terminals,
- a planar integrated switching device as claimed in any one of the preceding claims for providing switchable connections between said one or more signal input terminals and said one or more signal output terminals, and
- a switch control unit for generating a switch control signal for control of said planar integrated switching device.

Preferred embodiments of the invention are defined in the dependent claims. It shall be understood that the claimed device for the transmission of microwave signals has similar and/or identical preferred embodiments as the claimed planar integrated switching device and as defined in the dependent claims.

The present invention is based on the idea to deploy switching elements on slotlines within transmission paths. This enables that switching functionality can be achieved within any kinds of devices implemented as microwave or millimeter wave integrated circuit, such as filters, single-pole n-throw switch devices or other transmission devices, without requiring additional space and complicated matching networks for the switching elements.

In particular, according to the present invention it is proposed that on a slotline arranged between and connecting to CPW-slotline transition units at least one switching element is provided by which a transmission signal over a slotline from one CPW-slotline transition unit to the other CPW-slotline transition unit can be switched on and off under control of a switch control signal, that is preferably provided by an external switch control unit. Preferably, the suppression of a transmission signal over a slotline is achieved by such a switching element by short-circuiting the two conductor plates between which the slot is provided and between which electromagnetic fields are formed for signal transmission.

The device for the transmission of microwave signals generally has one or more signal input terminals and one or more signal output terminals between which the microwave signal (also called transmission signal herein) is to be transmitted. Such a device may, for instance, be a filter or a transceiver which could be used in communication or radar applications.

It shall be noted that herein with reference to micro- and millimeter waves a frequency range from approximately 0.3 GHz to 300 GHz is meant and that these terms are used interchangeably herein. Generally, principles of the use of coplanar waveguides and slotlines shall be applicable.

According to another aspect of the present invention a planar integrated switching device is presented comprising:

- at least two CPW-slotline transition means each including an access for inputting and/or outputting a transmission signal,
- a slotline means connecting said at least two CPW-slotline transition units, and
- a switching means arranged on said slotline between said at least two CPW-slotline transition units for switching the transmission signal over said slotline on and off under control of a switch control signal.

BRIEF DESCRIPTION OF THE DRAWINGS

These and other aspects of the present invention will be apparent from and explained in more detail below with reference to the embodiments described hereinafter. In the following drawings

DETAILED DESCRIPTION OF THE INVENTION

Figures 1A, 1B:
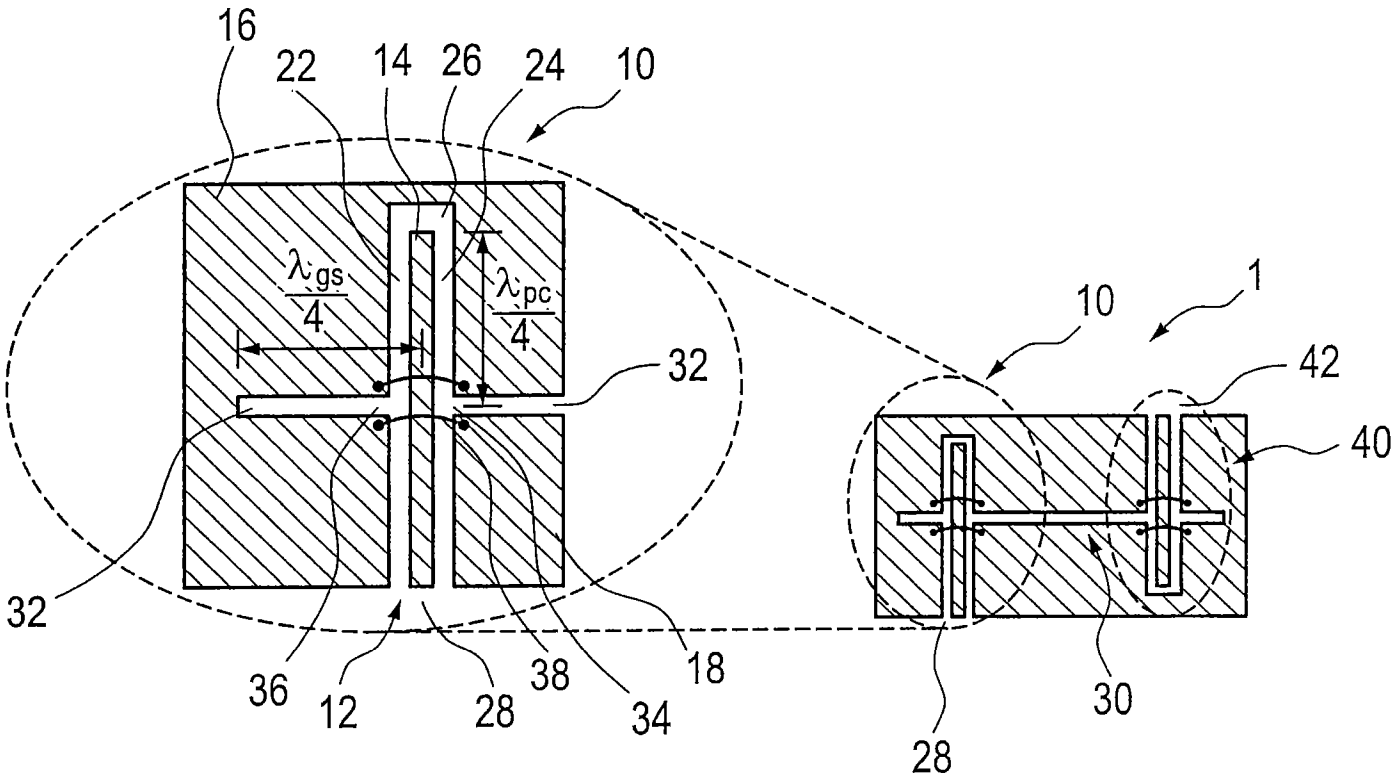
FIG. 1 shows an embodiment of a known CPW-slotline transition unit.
Figure 2:
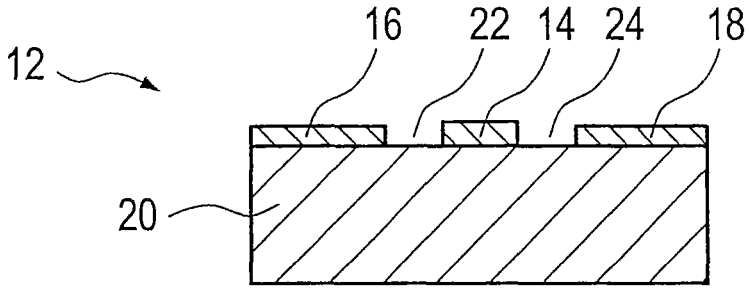
Fig. 2 RELATED ART
FIG. 2 shows a cross section of a coplanar waveguide.

FIG. 1 shows an embodiment of a CPW (Coplanar Waveguide)-slotline transmission device 1 as, for instance, described in C. Ho, L. Fan and K. Chang, "Transmission Line Modeling of CPW-Slotline Transitions and CPW Butterfly Filters", in IEEE MTT-S Digest, 1994, pp. 1305-1308. In particular, FIG. 1A shows a single CPW-slotline transition unit and FIG. 1B shows two CPW-slotline transition units connected via a slotline forming the CPW-slotline transmission device 1. The CPW-slotline transition unit 10 shown in FIG. 1A includes a CPW 12, wherein a central conductor 14 is formed between two outer conductors 16, 18, which are generally formed as plates on a substrate 20 as shown in the cross sectional view depicted in FIG. 2. The outer conductors 16, 18 are spaced from the central conductor 14 with forming a first slot 22 between the first outer conductor 16 and the central conductor 14 and with forming a second slot 24 between the second outer conductor 18 and the central conductor 14. At the inner end the CPW 12 is open-circuited with a gap 26 connecting to the first and second slots 22, 24. At the outer end they form a signal input and/or output access 28 for input and/or output of a signal to be transmitted through said CPW-slotline transmission device 1.

To provide a transition from the CPW 12 to a slotline 30, which is formed by a slot 32 between the two outer conductors 16 and 18, a junction 34 is placed at which the second slot 24 of the CPW 12 is connected to the slot 32 of the slotline 30 at a right angle. Opposite from the junction 34, a similar junction 36 is formed in the outer conductor 16, where the slot 32 of the slotline 30 extends one quarter-wavelength beyond the CPW 12 and terminates with a short circuit thus forming a short slotline stub. Similarly, the CPW 12 extends (in FIG. 1 in vertical direction) one quarter-wavelength beyond the slotline 30 and terminates with an open circuit thus forming an open CPW stub. In this way, electromagnetic waves entering into the CPW 12 through the access 28 are transmitted into the slotline 30.

Figure 3:
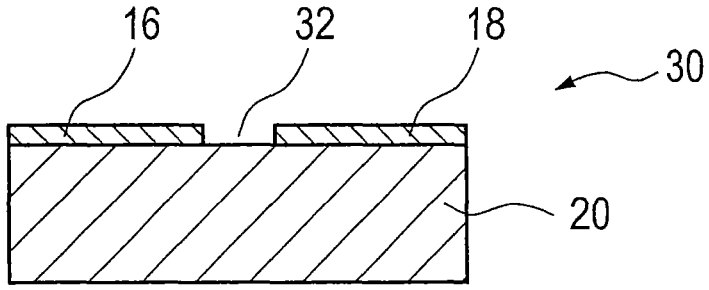
FIG. 3 shows a cross section of a slotline.

A cross section of the slotline 30 is also shown in FIG. 3 illustrating the slot 32 between the outer conductors (also called ground plates) 16, 18, which are also formed on the substrate 20.

The CPW-slotline transmission device 1 shown in FIG. 1B comprises the CPW-slotline transition unit 10, the slotline 30 and another CPW-slotline transition unit 40, which is identical to the first CPW-transition unit 10 and thus provides another signal input and/or output access 42.

Air bridges 38 are provided at the intersection of the CPW 12 and slotline 30 to eliminate parasitic slotline modes as commonly known.

The general layout and functionality of such a transmission device and their elements as well as the method for forming such a device as a planar millimeter wave integrated circuit are generally known in the art and are thus not explained in more detail herein. Such devices are generally provided for transmitting electromagnetic waves in the microwave and millimeter wave range typically from 0.3 to 300 GHz.

The guided wavelength is the wavelength of electromagnetic waves in a dielectric medium as a transmission structure. It is defined as free space wavelength over square root of a dielectric constant. $\lambda_{gs}$ and $\lambda_{gc}$ mean the wavelength on a slotline and on a CPW, respectively.

Figure 4:
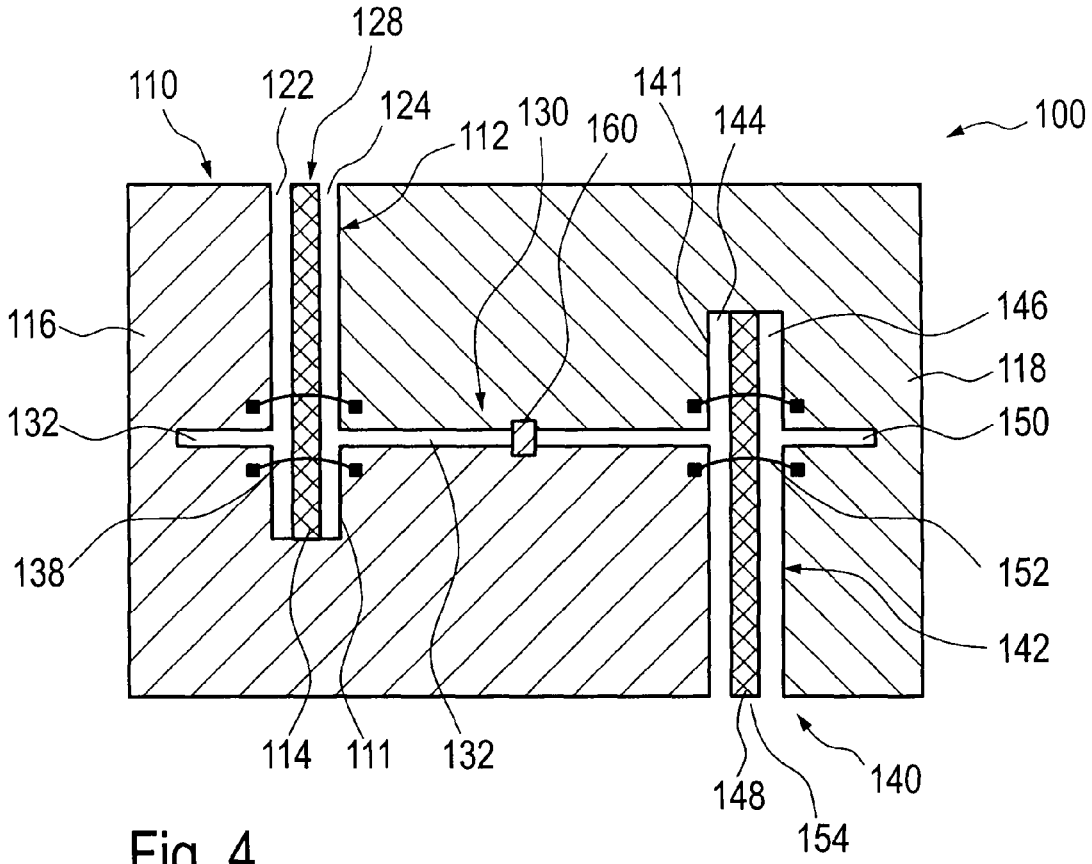
FIG. 4 shows a first embodiment of a planar integrated switching device according to the present invention.

FIG. 4 shows a first embodiment of a planar integrated switching device 100 according to the present invention. It comprises a first CPW-slotline transition unit 110, a second CPW-slotline transition unit 140 and a slotline 130 connecting the CPW 112 of the first CPW-slotline transition unit 110 and the CPW 142 of the second CPW-transition unit 140. Similarly as explained above with reference to FIGS. 1 and 2, two outer conductors 116, 118 are formed on a substrate, which are spaced from each other. The slotline 130 is formed by providing a slot 132 between said outer conductors 116, 118. Said slot 132 connects perpendicularly at one end into a first slot 124 of the first CPW 112 and at the other end into a first slot 144 of the second CPW 142. In this way their transitions from the CPWs 112, 142 to the slotline 130 are provided.

Each CPW 112, 142 further comprises a second slot 122 or 146, respectively. Between the two slots 122, 124 or 144, 146, of said CPWs 112, 142, a central conductor 114 or 148 is provided, respectively. Different from the embodiment shown in FIGS. 1A, 1B, however, the stubs 111, 141 of the CPWs 112, 142 beyond the slotline 130 do not end in an open stub, i.e. no connection slot is provided for connecting the two slots of each CPW, as indicated by reference numeral 26 in FIG. 1A, but in a short stub preferably having a length of a natural number multiple of a half guided wavelength of said CPW. In this way the open end effect on the CPW is avoided, and such short CPW stubs 111, 141 are more suitable for millimeter wave and microwave applications. Better transmission performance is achieved when the length of the slotline 130 between said CPWs 112, 142 is close to $(\lambda_{gs}/4)*(2n-1)$, wherein n=1, 2, . . . and $\lambda_{gs}$ is the guided wavelength of the slotline 130, i.e. odd of multiple of a quarter guided wavelength.

The slotline 130 also extends beyond the CPWs 112, 142 and ends in slotline stubs 132, 150, preferably being employed as a short circuit and having a length of an odd multiple of a quarter guided wavelength of said slotline 130.

Alternatively, the slotline stubs 132, 150 can have a radial or open circuit structure, and the CPW 112, 142 can also end in an open stub having an odd multiple of a quarter guided wavelength.

Also here, air bridges 138, 152 are provided above the CPWs 112, 142 to eliminate parasitic slotline modes as commonly known.

For providing a switching functionality it is proposed according to the present invention that a switching element 160 is arranged on the slotline 130 between said two CPW-slotline transition units 110, 140 so that the transmission of a signal over said slotline 130 can be switched on and off under control of a switch control signal. When the two conductors 116, 118 on both sides of the slot 132 of the slotline 130 are kept at the same (electrical) potential, the transmission between the accesses 128 and 154 can be suppressed, i.e. a transmission can be switched off. Hence, the basic idea of the present invention is to provide a switching element 160 by putting the two conductors 116, 118 on the same potential, in particular by making an electrical contact that can be opened and closed. For this purpose, generally any kind of switching element can be used.

Figure 5:
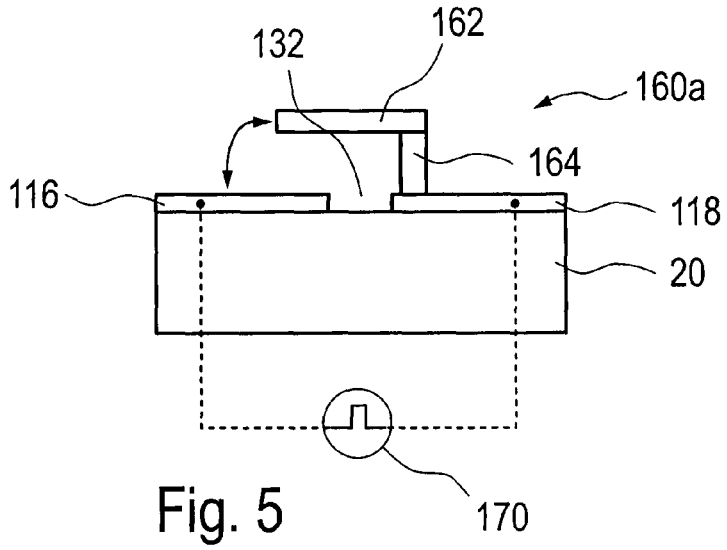
FIG. 5 shows a cross section of a first embodiment of a switching element according to the present invention.

In one embodiment, as illustrated in FIG. 5, a typical micro-electromechanical systems (MEMS) type switching element 160*a* as shown in FIG. 5 is provided. Said MEMS type switching element 160*a* includes a cantilever 162 formed on an anchor structure 164, that is in electrical contact with one of the conductors (here the conductor 118) and which bridges the slot 132. Under control of an external switch control signal 170, said cantilever 162 can make contact with the other conductor, here the conductor 116, to bring both conductors 116, 118 into contact. For instance, as shown by dashed lines, an external switch control unit 170 may be provided. If, for instance, by this external switch control unit 170 a positive potential is fed to the waveguide conductor 116 and a negative potential is fed to the waveguide conductor 118 the membrane 162 will be drawn to the waveguide conductor 116 and the switch will be closed. If the potentials provided to the waveguide conductors 116, 118 are removed the membrane 162 will return to the original position (as shown in FIG. 5), for instance due to an intrinsic force, so that the switch opens again.

In the embodiment of the planar integrated switching device shown in FIG. 4 the switching element 160 is preferably provided in the central area on the slotline 130 between the two CPWs 112, 142 or at the position defined above. Providing the switching element 160 in this area provides the highest isolation when the switching element is closed to block the transmission of a transmission signal.

In an embodiment the length of the slotline 130 between the two CPWs is selected to be $(\lambda_g/4)\cdot(2n-1)$, wherein n=1, 2, . . . and $\lambda_g$ is the guided wavelength of electromagnetic waves guided on the slotline, i.e. the length of the slotline is an odd multiple of a quarter of the guided wavelength of the slotline. The switching element 160 is thus preferably arranged at substantially an odd multiple of an eighth of the guided wavelength of said slotline.

Preferably, the switching element is arranged at a position of said slotline 130 where the suppression of the transmission signal is maximum.

Figure 6:
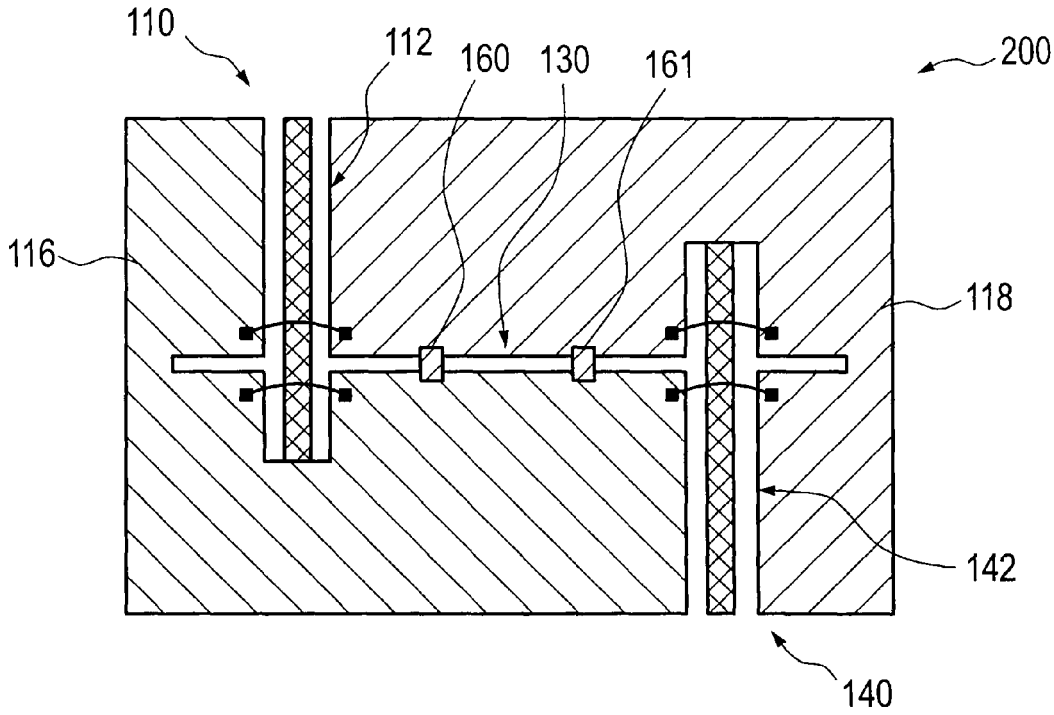
FIG. 6 shows a second embodiment of a planar integrated switching device according to the present invention.

FIG. 6 shows another embodiment of a planar integrated switching device 200 according to the present invention. Generally, the layout and function of said embodiment is identical to the layout and function of the planar integrated switching device 100 shown in FIG. 4. In this embodiment, however, two switching elements 160, 161 are arranged on the slotline 130 between the CPW-slotline transition units 110, 140. Generally, these switching elements 160, 161 are identical and controlled simultaneously by the identical switch control signal. For instance, both switching elements 160, 161 may be implemented as shown in FIG. 5. Preferably, a switching element is arranged every $\lambda_{gs}/4$ distance on the slotline 130 from the intersection of the slotline 130 and the CPW 112 or 142, which is the most efficient position in suppressing the transmission of signals over the slotline 130. To further increase the isolation even more switching elements may be provided on the slotline 130.

Figure 7:
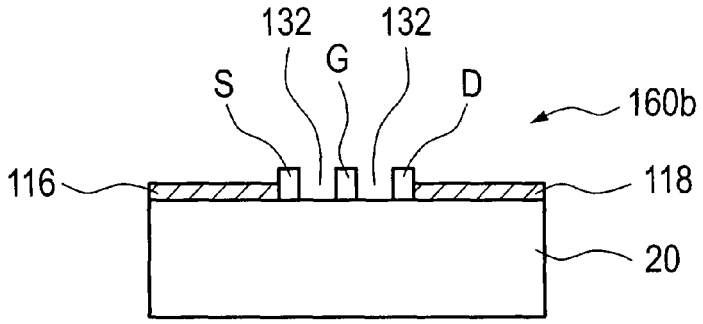
FIG. 7 shows a cross section of a second embodiment of a switching element according to the present invention.

Another embodiment of a switching element 160*b* is depicted in FIG. 7. In this embodiment the switching element 160*b* is implemented by use of a transistor whose source terminal S is connected to the first conductor 116, whose drain terminal D is connected to the other conductor 118, and whose gate terminal G is placed somewhere in between the source terminal S and gate terminal G within the slot 132. By providing a switch control signal to the gate terminal G the transistor switch 160*b* can be made conductive so that the conductors 116, 118 are electrically connected and put on the same potential as desired to block transmission signals over the slotline 130.

Figure 8:
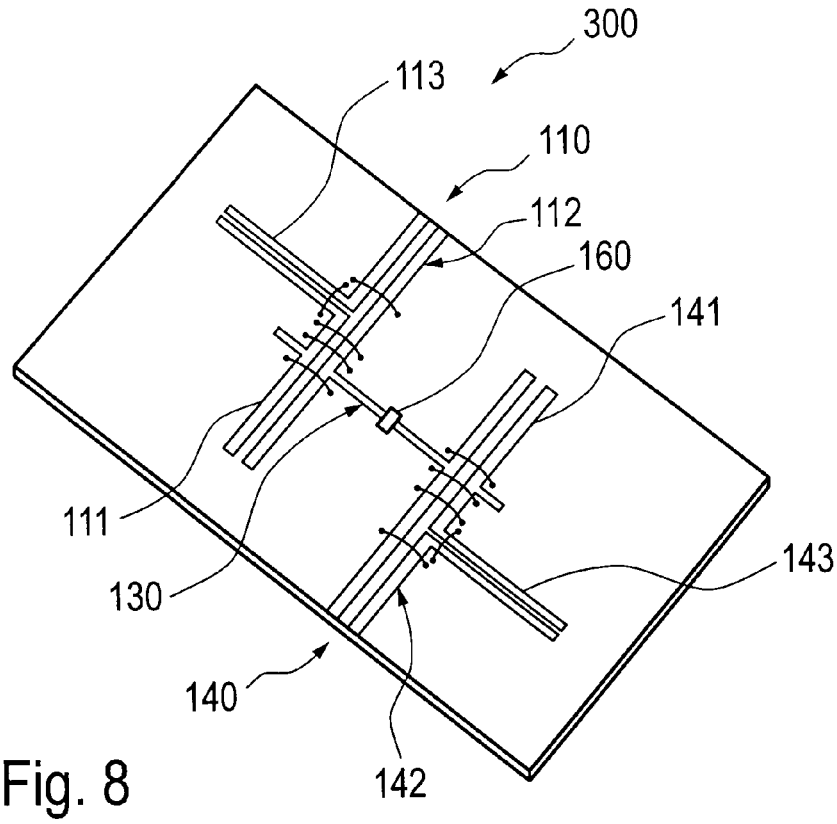
FIG. 8 shows a third embodiment of a planar integrated switching device according to the present invention.

Another embodiment of a planar integrated switching device 300 is depicted in FIG. 8. This embodiment also comprises two CPW-slotline transition units 110, 140 connected via a single slotline 130 on which a single (or more) switching element 160 is arranged as explained above. In this embodiment, however, additional short CPW stubs 113, 143 are provided on the side of the CPWs 112, 142. These CPW stubs 113, 143 are similarly formed as the CPW stubs 111, 141 but are connected to the respective CPW 112, 142 at a right angle. Thereby, the central conductor of the CPW stubs 113, 143 connects to the central conductor of the respective CPW 112, 142, and the two slots of the CPW stubs 113, 143 connect to the outer slot of the respective CPW 112, 142. Additional air bridges are provided as shown in FIG. 8 where the CPW stubs 113, 143 connect to the CPW 112, 142. By using additional CPW stubs 113, 143, the filtering function can be easily integrated in the switching device.

Figure 9:
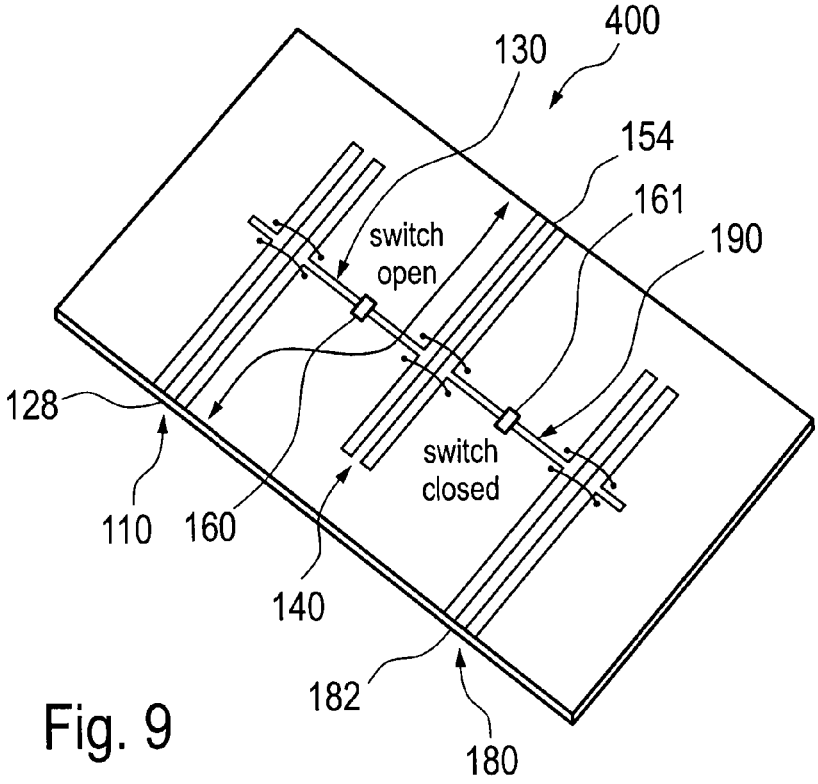
FIG. 9 shows a fourth embodiment of a planar integrated switching device according to the present invention.

In the embodiments of the planar integrated switching device two accesses are provided, and the transmission between said two accesses can be switched on and off. However, the idea of the present invention can also be used for a multi-pole application where one or more input accesses are connected to one or more output accesses, i.e. the basic switching configuration explained above can be easily extended into a single-pole n-throw switching configuration. An embodiment of a planar integrated switching device 400 having a single-pole double-throw (SPDT) switching configuration is shown in FIG. 9. In this embodiment three CPW-slotline transition units 110, 140, 180 are provided connected by slotlines 130, 190, wherein in each slotline 130, 190 a single (or more) switching element 160, 161 is provided. In the state shown in FIG. 9 the switching element 160 is open while the switching element 161 is closed so that a signal transmission is possible between accesses 128 and 154, but not to and from access 182.

Figure 10:
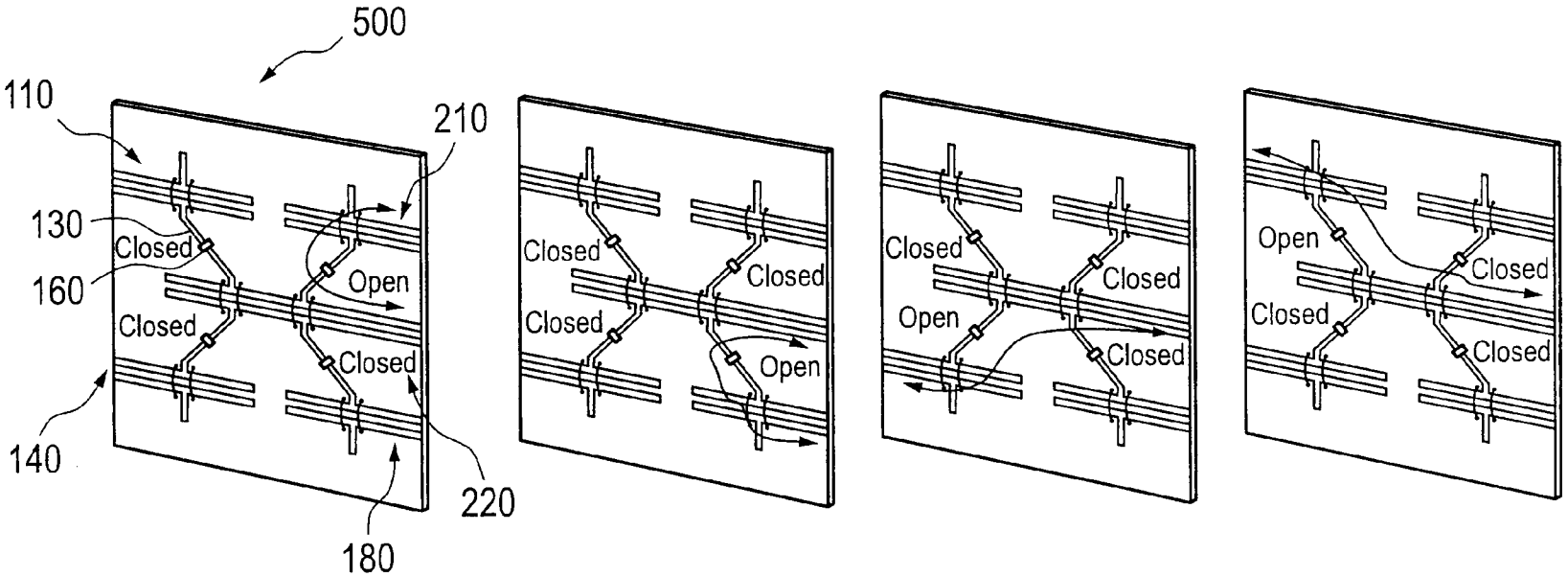
FIG. 10 shows a fifth embodiment of a planar integrated switching device according to the present invention in different switching states, FIG. 11 schematically shows a first embodiment of a transmission device according to the present invention, FIG. 12 schematically shows a second embodiment of a transmission device according to the present invention, and FIG. 13 schematically shows a third embodiment of a transmission device according to the present invention.

Another embodiment of a planar integrated switching device 500 comprising a single-pole 4-throw (SP4T) switching configuration is shown in various switching states in FIG. 10. Such an embodiment 500 (and also the embodiment 400 shown in FIG. 9) can be applied to a band-switching multiplexer. The embodiment 500 comprises five CPW-slotline transition units 110, 140, 180, 210, 220, wherein the CPW-slotline transition units 110, 140, 180, 210 are each separately connected to the CPW transition unit 220 by a separate slotline 130 each including a single (or more) switching element 160. Preferably, as shown in the various diagrams depicted in FIG. 10, for providing a transmission between two accesses each time only a single switching element 160 is open while all other switching elements are closed. The optimum distance between two intersections of the slotlines 130 and the CPW 220 in such an arrangement is $\lambda_{gc}/2$. As also shown in FIG. 10, the slotlines 130 need not be straight lines along their complete lengths, but can also be bent.

Figure 11:
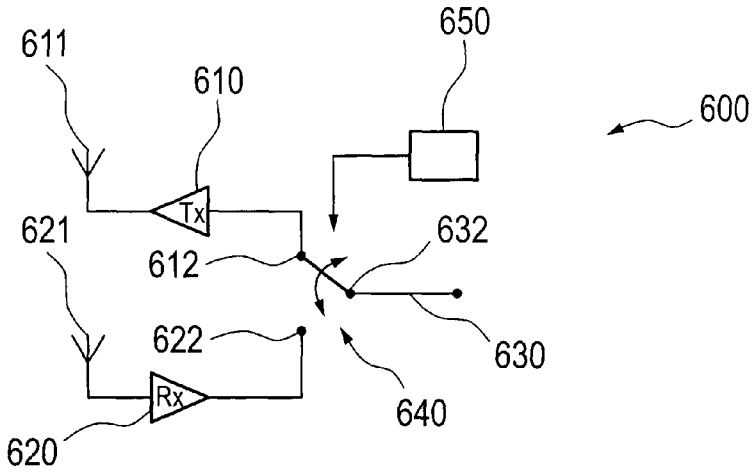

A first embodiment of a transmission device 600 is schematically depicted in FIG. 11. In this embodiment, which may be used in a telecommunications device, such as a mobile phone or a base station, a transmitter path 610 including a transmitter antenna 611 and a transmitter terminal 612 and a receiver path 620 including a receiver antenna 621 and a receiver terminal 622 are provided. To and from these transmitter paths 610 and receiver paths 620 signals may be transmitted via a connection path 630 having a connection terminal 632 which may be connected to either the transmitter path 610 or the receiver path 620 via the switching unit 640 which is implemented by a planar integrated switching device as described above and as proposed according to the present invention. The switching unit 640 is under control of a switch control 650 which provides a switch control signal to bring the switch 640 into the right position.

Figure 12:
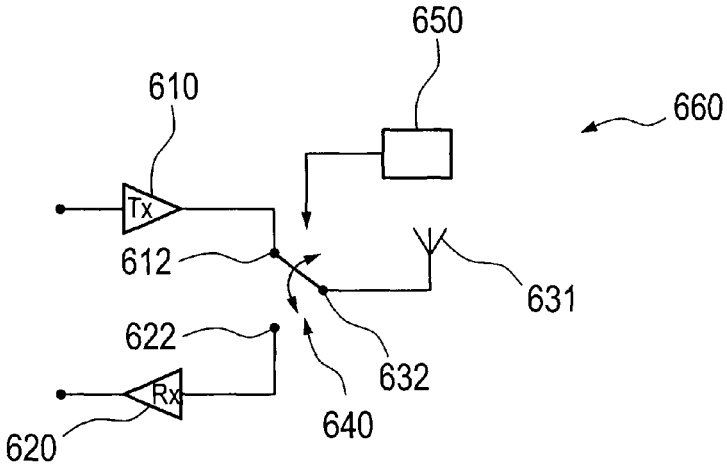

Another embodiment of a transmission device 660 is schematically depicted in FIG. 12. Said embodiment is quite similar to the embodiment shown in FIG. 11, but comprises a single shared antenna 631 coupled to the connection terminal 632. Said shared antenna 631 is thus shared between the transmitter path 610 and the receiver path 620 for transmitting or receiving signals. Such an embodiment may, for instance, also be used in a telecommunications device.

Figure 13:
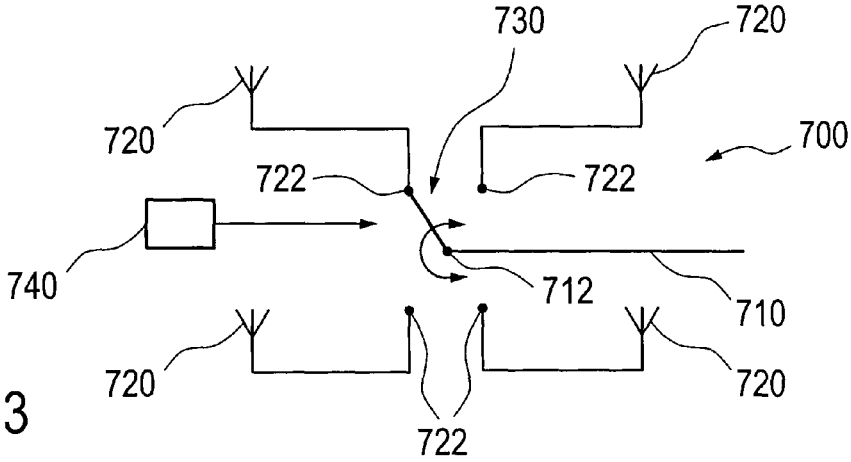

Still another embodiment of a transmission device 700 is schematically depicted in FIG. 13. Such an embodiment may be used in a phased array or multi-antenna application where a single connection path 710 having a connection terminal 712 shall be connected with a desired one of multiple (here four) antennas 720 each having an antenna terminal 722. This is again enabled through a switch 730 whose switching position is controlled by a switching unit 740 and which is implemented by a planar integrated switching device as explained above and as proposed according to the present invention.

Further applications are possible in these and other technical fields where signals shall be selectively transmitted between at least two terminals, for instance in telecommunications, radar technology or antenna applications.

Hence, as explained above, by placing one or more switching elements within a transmission path or filter a switching function can be added without consuming additional space compared to a conventional configuration of a switching element connected as separate element in series to the transmission element or filter. Consequently, no additional matching networks are needed between a transmission path or filter and the switching elements, which would lead to design complexity and require space in the known configurations. The basic switching configuration can be easily extended into an SPnT (Single-Pole n-throw) switching configuration, and the arrangement of identical 50 Ohm CPW transition lines through slotlines is sufficient to compose SPnT switches without using any complicated matching networks.

The invention has been illustrated and described in detail in the drawings and foregoing description, but such illustration and description are to be considered illustrative or exemplary and not restrictive. The invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A planar integrated switching device comprising:
at least two CPW-slotline transition units each including an access configured to input and/or output a transmission signal;
a slotline connecting said at least two CPW-slotline transition units; and
a switching element arranged on said slotline between said at least two CPW-slotline transition units and configured to switch the transmission signal over said slotline on and off under control of a switch control signal, wherein
said switching element is arranged at a position of said slotline where suppression of the transmission signal is maximum.

2. A planar integrated switching device as claimed in claim 1, wherein
said switching element is adapted for short-circuiting conductor plates of said slotline under control of said switch control signal.

3. A planar integrated switching device as claimed in claim 1, wherein
said switching element is formed by a MEMS switch, a diode or a transistor.

4. A planar integrated switching device as claimed in claim 1, wherein
said switching element is arranged at substantially the same distance from said at least two CPW-slotline transition units.

5. A planar integrated switching device as claimed in claim 1, wherein
the length of said slotline is an odd multiple of a quarter of the guided wavelength of said slotline.

6. A planar integrated switching device as claimed in claim 1, wherein
said switching element is arranged at one quarter wavelength distance on said slotline from the intersection of said slotline and CPW.

7. A planar integrated switching device as claimed in claim 1, further comprising:
at least two switching elements arranged on said slotline between said at least two CPW-slotline transition units.

8. A planar integrated switching device as claimed in claim 1, further comprising:
at least three CPW-slotline transition units, where each CPW-slotline transition unit is connected to at least one other CPW-slotline transition unit through a slotline.

9. A planar integrated switching device as claimed in claim 8, wherein
at least one switching element is arranged on each slotline.

10. A planar integrated switching device as claimed in claim 1, wherein
each CPW-slotline transition unit comprises a CPW, and
said slotline crosses the CPW at a right angle and extends beyond said CPW.

11. A planar integrated switching device as claimed in claim 10, wherein said slotline ends in a slotline stub beyond said CPW, said slotline stub being employed as an open circuit.

12. A planar integrated switching device as claimed in claim 10, wherein said slotline ends in a slotline stub beyond said CPW, said slotline stub being employed as a radial stub.

13. A device for the transmission of microwave signals comprising:

one or more signal input terminals;

one or more signal output terminals;

a planar integrated switching device as claimed in claim 1 for providing switchable connections between said one or more signal input terminals and said one or more signal output terminals; and a switch control unit for generating a switch control signal for control of said planar integrated switching device.

14. A device as claimed in claim 13, wherein said device comprises at least one antenna, each antenna being connected to a single one of said terminals.

15. A planar integrated switching device comprising:

at least two CPW-slotline transition units each including an access configured to input and/or output a transmission signal;

a slotline connecting said at least two CPW-slotline transition units; and a switching element arranged on said slotline between said at least two CPW-slotline transition units and configured to switch the transmission signal over said slotline on and off under control of a switch control signal, wherein each CPW-slotline transition unit comprises a CPW, said slotline crosses the CPW at a right angle and extends beyond said CPW, and said CPW extends beyond said slotline and ends in a CPW stub beyond said slotline, said CPW stub being employed as a short circuit and having a length of a natural multiple of a half guided wavelength of said CPW.

16. A planar integrated switching device comprising:

at least two CPW-slotline transition units each including an access configured to input and/or output a transmission signal;

a slotline connecting said at least two CPW-slotline transition units; and a switching element arranged on said slotline between said at least two CPW-slotline transition units and configured to switch the transmission signal over said slotline on and off under control of a switch control signal, wherein each CPW-slotline transition unit comprises a CPW, said slotline crosses the CPW at a right angle and extends beyond said CPW, and said CPW extends beyond said slotline and ends in a CPW stub beyond said slotline, said CPW stub being employed as an open circuit and having a length of an odd multiple of a quarter guided wavelength of said CPW.

17. A planar integrated switching device comprising:

at least two CPW-slotline transition units each including an access configured to input and/or output a transmission signal;

a slotline connecting said at least two CPW-slotline transition units; and a switching element arranged on said slotline between said at least two CPW-slotline transition units and configured to switch the transmission signal over said slotline on and off under control of a switch control signal, wherein each CPW-slotline transition unit comprises a CPW, said slotline crosses the CPW at a right angle and extends beyond said CPW, and said CPW extends beyond said slotline and ends in a CPW stub beyond said slotline, said CPW stub being employed as a radial stub.

18. A planar integrated switching device comprising:

at least two CPW-slotline transition units each including an access configured to input and/or output a transmission signal;

a slotline connecting said at least two CPW-slotline transition units; and a switching element arranged on said slotline between said at least two CPW-slotline transition units and configured to switch the transmission signal over said slotline on and off under control of a switch control signal, wherein each CPW-slotline transition unit comprises a CPW, said slotline crosses the CPW at a right angle and extends beyond said CPW, and said slotline ends in a slotline stub beyond said CPW, said slotline stub being employed as a short circuit and having a length of an odd multiple of a quarter guided wavelength of said slotline.

19. A planar integrated switching device comprising:

at least two CPW-slotline transition means each including an access for inputting and/or outputting a transmission signal, a slotline means connecting said at least two CPW-slotline transition units, and a switching means arranged on said slotline between said at least two CPW-slotline transition units for switching the transmission signal over said slotline on and off under control of a switch control signal, wherein said switching means is arranged at a position of said slotline means where suppression of the transmission signal is maximum.

* * * * *